United States Patent [19]

Tokunga et al.

[11] Patent Number: 4,921,553

[45] Date of Patent: May 1, 1990

[54] MAGNETICALLY ANISOTROPIC BOND MAGNET, MAGNETIC POWDER FOR THE MAGNET AND MANUFACTURING METHOD OF THE POWDER

[75] Inventors: Masatoki Tokunga, Fukaya; Yasuto Nozawa; Katsunori Iwasaki, both of Kumagaya, all of Japan

[73] Assignee: Hitachi Metals, Ltd., Tokyo, Japan

[21] Appl. No.: 26,969

[22] Filed: Mar. 17, 1987

[30] Foreign Application Priority Data

Mar. 20, 1986 [JP] Japan ..... 61-62174
May 9, 1986 [JP] Japan ..... 61-106187

[51] Int. Cl.[5] ..... H01F 1/04

[52] U.S. Cl. ..... 148/302; 75/244; 252/62.54; 148/101

[58] Field of Search ..... 75/251, 244; 252/62.54; 420/83, 121; 148/302

[56] References Cited

U.S. PATENT DOCUMENTS

| | | | |
|---|---|---|---|
| 4,192,696 | 3/1980 | Menth et al. | 148/101 |
| 4,402,770 | 9/1983 | Koon | 148/302 |
| 4,597,938 | 7/1986 | Matsuura et al. | 419/23 |
| 4,601,875 | 7/1986 | Yamamoto et al. | 419/23 |

FOREIGN PATENT DOCUMENTS

| | | | |
|---|---|---|---|
| 0106948 | 5/1984 | European Pat. Off. . | |
| 0125752 | 11/1984 | European Pat. Off. | 148/302 |
| 0133758 | 3/1985 | European Pat. Off. . | |
| 0187538 | 7/1986 | European Pat. Off. . | |
| 59-46008 | 3/1984 | Japan . | |
| 59-64733 | 4/1984 | Japan . | |
| 59-64739 | 4/1984 | Japan . | |
| 59-219904 | 12/1984 | Japan . | |
| 60-9852 | 1/1985 | Japan . | |
| 60-27105 | 2/1985 | Japan . | |
| 60-100402 | 6/1985 | Japan . | |

OTHER PUBLICATIONS

K. Gudimetta et al.; "Magnetic Properties Fe-R-B Powders"; Appl. Phys. Lett. 48(10); Mar. 10, 1986; pp. 670-672.

*Primary Examiner*—John P. Sheehan
*Attorney, Agent, or Firm*—Finnegan, Henderson, Farabow, Garrett & Dunner

[57] ABSTRACT

Magnetically anisotripic powder and resin-bonded magnets made therefrom have "flattened" crystal grains of an R-TM-B-M system alloy with preferably (c)/(a) greater than 2, where (c) is the grain size perpendicular to the C-axis and (a) the grain size parallel to the C-axis. The "flattened" grains are produced by plastically deforming a green compact of flakes formed by rapidly-quenching an alloy melt, and then crushing the plastically deformed body. In the allow system, R is at least one of the rare earth elements including Y, TM is Fe or Fe a part of which has been substituted with Co, B is boron, and M is an additive selected from Si, Al, Nb, Zr, P and C.

30 Claims, 1 Drawing Sheet

Sole

MAGNETICALLY ANISOTROPIC BOND MAGNET, MAGNETIC POWDER FOR THE MAGNET AND MANUFACTURING METHOD OF THE POWDER

FIELD OF THE INVENTION

This invention relates to a permanent magnet in which an alloy powder of a rare earth elements-iron-boron system has been dispersed in resin, particularly to a resin bonded permanent magnet in which the alloy powder of rare earth elements-iron-boron having magnetic anisotropy has been dispersed in resin.

BACKGROUND OF THE INVENTION

Typical rare earth permanent magnets include permanent magnet of the $SmCo_5$ system and a permanent magnet of the $Sm_2Co_{17}$ system. These samarium cobalt magnets are produced using the following procedures: An ingot composed of samarium and cobalt is made by mixing samarium and cobalt and then melting the mixture in a vaccum or an inactive atmosphere. After the ingot has been crushed into fine powder, the powder is molded in a magnetic field and a green body is obtained. A permanent magnet is made by sintering the green body and then heat treating the sintered body.

As mentioned above, the samarium cobalt magnet is provided with magnetic anisotropy by being molded in a magnetic field. The magnetic properties of the magnet are improved substantially by providing such magnetic anisotropy. Anisotropic resin-bonded permanent magnets can be obtained by mixing crushed powder from a sintered anistropic samarium cobalt magnet with resin and molding the powder in a magnetic field, either by injecting it into a molding die or by compressing it in a molding die.

In this way, a resin-bonded samarium cobalt magnet can be produced by first making a sintered magnetically anisotropic magnet and then by crushing and then mixing it with resin.

As compared with the samarium cobalt magnet, a rare earth magnet of a new type, that is, a neodymium-iron-boron magnet, has been proposed. Japan Patent Laid-Open Nos. Showa 59-46008 and Showa 59-64733 have proposed that, in the same way as in a samarium cobalt sintered magnet, an ingot of the neodymium-iron-boron alloy be prepared, crushed into fine powder, and molded in a magnetic field to obtain the green body. By sintering the green body and heat-treating the sintered body, a sintered permanent magnet is prepared. This method is called the powder metallurgy method.

Apart from the abovementioned powder metallurgy method, a different manufacturing method of the Nd-Fe-B system permanent magnet has been proposed in certain Japanese Patent Laid-Opens as follows:

| (Japanese Patent Laid-Open) | (Based on U.S. Pat. Application) |
|---|---|
| No. 59-64739 | No. 414,936 (Sept. 3, 1982)<br>No. 508,266 (June 24, 1983) |
| No. 60-9852 | No. 508,266 (June 24, 1983)<br>No. 544,728 (Oct. 26, 1983) |
| No. 60-100402 | No. 520,170 (Aug. 4, 1983) |

According to these publications, after neodymium, iron and boron have been mixed and melted, molten metal is rapidly quenched using such technology as spinning. The $Nd_2Fe_{14}B$ alloy is crystallized by heat-treating the resulting flakes of the noncrystalline alloy. Patent Laid-Open No. 60-100402 describes technology as to furnish the isotropic magnetic alloy with magnetic anisotropy by forming a green body by a hot press procedure and thereafter causing plastic streaming in a part of the green body under high temperature and high pressure. This NdFeB magnet has the following problems:

Firstly, although the abovementioned powder metallurgy process provides a magnet with magnetic anisotropy and the obtainable magnetic property is as high as 35–45 MG Oe, its Curie point is substantially low, its crystal grain size is also large, and its thermal stability is inferior compared to samarium cobalt magnets. Accordingly, these NdFeB magnets have not been widely used for motors, etc. operating in a high temperature environment.

By contrast, although mixing a powder made from the rapidly-quenched flakes with resin could theoretically make compression molding comparatively easy, the obtainable magnetic property of the bond magnets so obtained is low because of the magnetic isotropy of the powder. For example, the magnetic property obtainable by injection molding of the isotropic powder would be (BH)max=3–5 MGOe and the one obtainable by compressing molding would be (BH)max=8–10 MGOe. In addition, the magnetic property would depend on the strength of the magnetizing magnetic field. In order to obtain (BH)max=8 MGOe, the strength of the magnetizing magnetic field of about 50 KO3 would be required and it would be difficult to use this magnet in applications requiring magnetization after it has been assembled.

The hot pressing of the rapidly-quenched powder would improve the weather-proof property as the result of the density increase which makes the magnet free of voids, but since it has isotropy, it has the same problems as in the case of a permanent magnet made by directly mixing the rapidly-quenched powder with resin. Although the obtainable (BH)max would be increased because of the increase in density such that about 12 MGOe is obtainable, it is still impossible to magnetize it after assembled due to the large applied field required.

By causing plastic streaming of the rapidly-quenched powder after a hot press, it would be possible to furnish the magnet with magnetic anisotropy in the same way as in the case by the powder metalurgy process and obtain a (BH)max of 35–40 MGOe. However, it would be difficult to make a ring type magnet (for example, a magnet of 30 mm outside diameter×25 mm inside diameter×20 mm thickness) because the use of an upsetting process would be required to furnish the magnet with the required magnet anisotropy and dimensional control, especially of relatively small articles, is exceedingly difficult with such a process.

As described at pages 670–672 of the Applied Physics Letters 48 (10), Mar. 1986, it is possible to furnish a magnet with magnetic anisotropy by crushing a melt-cast ingot into powder having a grain 0.5–2 μm and then making a bond magnet by solidifying the crushed powder with wax. However, on account of the fineness of the powder, its flamability makes handling it in air virtually impossible. In addition, since the squareness ration of the demagnetization curve of the powder is comparatively low, the magnet cannot provide a high magnetic property.

In an attempt to obtain a bond magnet with magnetic anisotropy, a sintered magnet with magnet anisotropy made by the powder metallurgy process was crushed, the crushed particles were mixed with resin and the magnet body was molded in a DC magnetic field. However, the magnetic properties in characteristic of the present invention were unobtainable.

SUMMARY OF THE INVENTION

The object of the invention is to eliminate such shortcomings as abovementioned caused by a dependence on conventional technologies. Another object of the invention is to provide a magnetically anisotropic bond magnet which has excellent thermal stability and a high magnetizing property to allow magnetization after assembly of the magnet, as well as to provide manufacturing method thereof.

DESCRIPTION OF THE PREFERRED EMBODIMENTS

Figure 1:
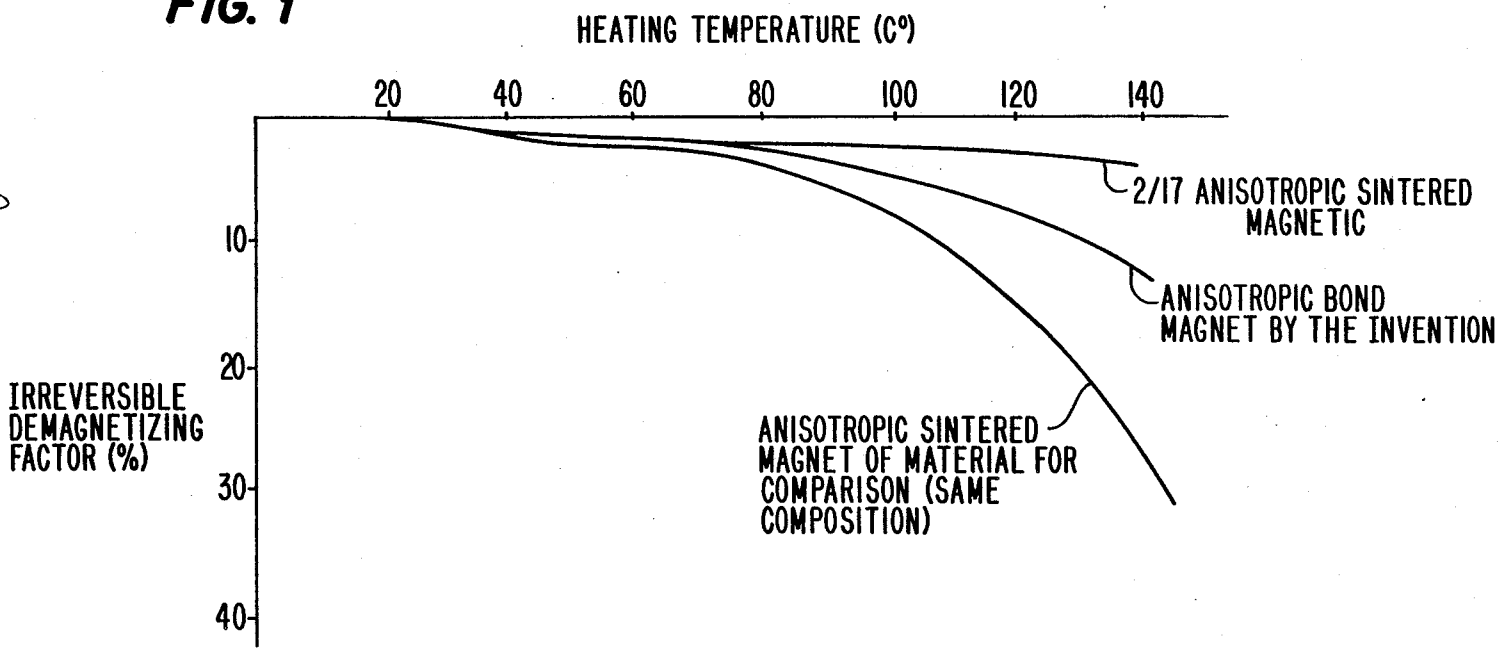
FIG. 1 shows a comparison of thermal stability among the anisotropic bond magnet and two anistropic sintered magnets, one composed of $Nd_{13}DyFe_{79}B_6Al$, and the other a $Sm_2Co_{17}$ system magnet.

The abovementioned objects are accomplished by using a magnetically anisotropic powder for bond magnet, which is made from R-TM-B-M system alloy (in which R is at least one of rare earth elements inclusive of Y, TM is Fe or Fe a part of which as been substituted with Co, B is boron, and M is at least one material selected from the group of Si, Al, Nb, Zr, Hf, Mo, P and C as additives, if required), and has the average crystal grain size of 0.01–0.5 μm, and the average grain size of 1–1,000 μm.

The abovementioned alloy preferably consists essentially of 11–18 at % of R, 4–11 at % of B, 30 at % or less of Co, and the balance of Fe and unavoidable impurities and more preferably 11–18 at % of R, 4–11 at % of B, 30 at % or less of Co, 0.001–3% of the additives (the additive is at least one selected from the group of Si, Al, Nb, Zr, Hf, Mo, P and C) and the balance of Fe and unavoidable impurities.

In order to obtain a magnetically anisotropic bond magnet with particularly high properties, it is required that the residual induction in the anisotropic direction of the R-Fe-B system alloy to be crushed should be 8 KG or more.

In addition, the R-Fe-B system alloy preferably should be the alloy furnished with magnetic anisotropy by plastic deformation of a compacted body of flakes of the alloy, after flakes of the alloy obtained by the rapidly-quenching process have been highly densified by a hot isostatic press (HIP) or a hot press (HP) step. One of the abovementioned measures for plastically deforming the alloy is the hot upsetting process or hot die-upsetting process.

The amount of the additive elements preferably is 0.001–3 at % and it is preferable that the average ratio of c to a is 2 or more in which (c) is the average crystal grain size in the direction perpendicular to the C axis of the grain and (a) is the average crystal grain size in the direction of the C axis.

In this specification, the term "R-Fe-B system alloy furnished with magnetic anisotropy" means an R-Fe-B system alloy showing the anisotropic magnetic property in which the shape of the second quadrant of the $4\pi$ I-H demagnetization curve is different depending on the magnetizing direction. The residual induction of a consolidated body made by HIP from rapid-quenched flakes is usually 7.5 KG or less and, by using an R-Fe-B alloy which has a residual induction of 8 KG or more, made in accordance with the present invention, it is possible to make a high performance bond magnet which has a residual magnetic flux density and an energy product both higher than those of an isotropic bond magnet. In the invention when the average crystal grain size becomes greater than 0.5 μm, the intrinsic coersive force (IHc) is lowered and the irreversible demagnetizing coefficient at 160° C. becomes 10% or higher resulting in a significant decrease in thermal stability which restricts potential uses of the magnet. In addition, when the average crystal grain size is smaller than 0.01 μm, the IHc of the bond magnet after molding is low and it is impossible to obtain the desired permanent magnet. Therefore, the average crystal grain size should be 0.01–0.5 μm.

Manufacture of the magnetic powder of the invention is carried out as follows:

To begin with, an alloy with a prescribed composition is melted by high-frequency induction melting, arc melting, etc. and the molten alloy is solidified to produce flakes by a rapid-quenching process. For the rapid-quenching step, either the single roll method or the double roll method is applicable and the material of the rolls may be Fe, Cu, etc. When using Cu, it is preferable to use Cr plated rolls. In order to prevent oxidation, rapid-quenching is carried out in an inert gas atmosphere of Ar, He, etc. The flakes are crushed into a coarse grain size of about 100–200 μm. By molding the crushed coarse grain powder at room temperature, a green body is obtained. By carrying out HIP or hot press of the green body at 600°–750° C., it is possible to manufacture a compressed block having a comparatively small crystal grain size. By upsetting the block at 600°–750° C. an anisotropic flat plate can be obtained. The greater the deformation ratio is, the greater the degree of anisotropy. If necessary, the IHc property obtainable is improved by heat treating the flat plate at 600°–800° C. By crushing the flat plate, a coarse powder especially useful for magnetically anisotropic bond magnets can be obtained.

By plastic deforming, the crystal grain of the R-Fe-B system alloy furnished with magnetic anisotropy shows the flat shape in the direction of the C axis. An average ratio (c)/(a) being 2 or more in which (c) is the average crystal grain size in the direction perpendicular to the C axis and (a) is the average crystal grain size in the direction of the C axis, is desirous for the purpose of obtaining a residual induction of 8 KG or more. The term "average crystal grain size" in this patent application means the average value of the diameters of spheres which have the same volume as those of a sample including more than 30 crystal grains.

In the case of plastic deformation being accomplished by hot upsetting, it is possible to obtain the particularly high magnetic property.

By heat treating to the magnetically anisotropic R-Fe-B system magnet, the coersive force of the magnet can be increased.

A preferred range of heat treatment temperatures is from 600° C. to 900° C. The reason thereof is because, with a heat treatment temperature below 600° C., the coersive force cannot be increased whereas, with a temperature over 900° C., the coersive force becomes lower than that before heat treatment.

The time required for the temperature of the samples to become uniform may be acceptable as the time for the coersive force. Therefore, the retention time was set to 240 minutes or less taking the industrial productivity into account.

The cooling speed should be 1° C./sec or higher. With a cooling speed lower than 1° C./sec, the coersive force becomes lower than before heat treatment. Hereinabove, the cooling speed means the average cooling speed with which a heat treatment temperature (°C.) goes down (the heat treatment temperature + room temperature) ÷ 2(°C.).

The term "R-Fe-B system alloy" means such an alloy that contains $R_2Fe_{14}B$ or $R_2$ (Fe, Co)$_{14}$B as the main phase. The reasons for the range of compositions recommended above for use in permanent magnets are as follows:

In the case where R (a combination of at least one of rare earth elements including Y) is less than 11 at %, sufficient IHc cannot be obtained and, in the case where R exceeds 18 at %, Br becomes lower. The amount of R preferably should be 11–18 at %, accordingly.

In the case where the amount of B is less than 4 at %, formation of the $R_2Fe_{14}B$ phase, which is the main phase of the magnet, is insufficient and both Br and IHc are low. In addition, in the case the amount of B exceeds 11 at %, Br is lowered due to the formation of an undesireable alloy phase in terms of magnetic properties. The amount of B should preferably be 4–11 at %, accordingly.

In case the amount Co exceeds 30 at %, the Curie point is improved but the anisotropy constant of the main phase is lowered and a high IHc cannot be obtained. The amount of Co preferably should be 30 at % or less, accordingly. Si, Al, Nb, Zr, Hf, P and C may be added to the alloy additives.

Si has the effect of causing the Curie point to go up and Al, Nb and P have the effect of causing the coersive force to go up.

C is an element which is apt to be mixed in at the time of electrolysis but, if the amount is small, it does not affect adversely the magnetic properties. Nb, Zr, Hf and Mo improve the anti-corrosive property.

In case the amount of these additive elements is less than 0.001 at %, the effect of these added elements is insufficient but in case such amount exceeds 3 at %, Br is lowered significantly and this is undesireable. The amount of the additive elements preferably should be 0.001 at %–3 at %, accordingly.

In addition, it is permitted that the impurity of Al often included in ferro-boron, or reducing agents and impurities unavoidably included during the process of reducing rare earth elements may exist in the alloys of the invention.

If the average grain size is smaller than 1 μm, it is apt to cause a highly flammable condition and handling such powder in the air atmosphere is difficult. If the average grain size is greater than 1,000 μm, it is difficult to construct a thin magnet (thickness 1–2 mm) and such powder is not suited to injection molding, as well. Such being the case, the average grain size should preferably be in the abovementioned range.

For the crushing step, the usual methods used for making the magnetic powder are available, namely, disc mill, brown mill, attritor, ball mill, vibration mill, jet mill, etc. By adding the thermoseting binder to the said coarse powder and causing the powder to thermoset after compression molding in a magnetic field, it is possible to obtain an anisotropic bond magnet of the compression molded type. In addition, by adding a thermoplastic binder to the coarse powder and injection molding, it is possible to obtain an anisotropic bond magnet of the injection molded type.

Among the materials which can be used as the aforementioned binder, the easiest to use in case of compression molding are the thermosetting resins. Polyamide, plyimide, polyester, polyphenol, fluorine, silicon, epoxy, etc. can be used all of which show thermal stability. In addition, Al, Sn, Pb and various sorts of soldering alloys of low melting points can be used. In case of injection molding, thermoplastic resin such as EVA, nylon, etc. can be used in accordance with the intended applications.

EXAMPLES

Further detailed descriptions of the invention will be made hereinunder with the following examples.

Example 1

An $Nd_{17}Fe_{75}B_8$ alloy was made by arc fusing, and flake-shaped filaments of the alloy were produced by rapid-quenching with the single roll method in an Ar atmosphere. The peripheral speed of the roll was 30 m/sec and the obtained filaments were about 30 μm thick of indeterminate form and, as a result of the X-ray diffraction, were found to be composed of mixtures of the amorphous phase and crystal phase. After rough crushing these filaments to 32 mesh or under, a green body was made by die compacting. The molding pressure was 6 ton/cm$^2$ and was done without application of a magnetic field. The density of the green body was 5.8 g/cc. The green body was hot pressed at 700° C. with a pressure of 2 ton/cm$^2$. The density of the molded body obtained by hot pressing was 7.30 g/cc, a high density. The bulk body with the high density was furthermore processed by upsetting at 700° C. The height of the sample was adjusted so as to make the deformation ratio 3 when compared before and after upsetting processing. (The deformation ration ho/h = 3, when ho is the height before upsetting and h is the sample height after upsetting.)

The sample processed by upsetting was heated up to 750° C. in an Ar atmospher and, after retaining the sample at that temperature for a period of time, the sample was water cooled. The cooling speed was 7° C./sec.

The magnetic properties before and after heat treatment are shown in Table 1. It can be seen that the coersive force is improved by heat treatment.

TABLE 1

| | Magnetic properties of magnet before and after heat treatment | | | |
|---|---|---|---|---|
| | Br(Kg) | \|Hc(KOe) | IHc(KOe) | (BH)max (MGOe) |
| Before heat treatment | 9.3 | 4.2 | 4.8 | 15 |
| After heat treatment | 9.3 | 7.5 | 13.0 | 19 |

By rough crushing the heat treated sample and adjusting the range of the grain size of the crushed sample to 250–500 μm, a magnetic powder was obtained. 16 vol % of epoxy resin was mixed with the magnetic powder in a dry mixer and lateral magnetic field molding of the powder carried out in a magnetic field of 10 KOe. Next, by thermosetting at 120° C. for 3 hrs., the molded body was made into an anisotropic bond magnet. When measured in a magnetizing magnetic field of 25 KOe, the anisotropic bond magnet showed such magnetic properties as Br=6.8 KG, BHc=6.3 KOe, IHc=12.3 KOe, (BH)max=10.6 MGOe.

For the purpose of comparison, the rapidly-quenched filaments of an alloy composed of $Nd_{17}Fe_{75}B_8$ were heat treated in a vacuum at 600° C. for 1 hr, rough crushed 250–500 μm, and made into a bond magnet using the same method as the one used for the example.

However, application of a magnetic field was not made during the compression molding step of the comparative bond magnet because the magnet was intended to be isotropic. The magnetic properties obtained by the strength of the magnetizing magnetic field of 25 KOe were Br=5.9 KOe, BHc=4.9 KOe, IHc=12.8 KOe, (BH)max=6.6 MGO. When compared with the isotropic bond magnet, it is found that the anisotropic bond magnet made by the invention has the better magnetizing properties and can obtain the higher magnetic properties. In addition, for the purpose of comparing these magnetic properties of the invention, a piece of ingot of an alloy composed of $Nd_{17}Fe_{75}B_8$ was rough crushed, mixed with the binder, molded in a magnetic field and treated with thermosetting with the same method as the one used for the example. The magnetic properties obtained by the strength of the magnetizing magnetic field of 25 KOe were Br=5 KOe, BHc=0.8 KOe, IHc=1.2 KOe, (BH)max=1.2 MGOe. In such a way as this, it can be seen that the anisotropic bond magnet prepared from ingot as raw material, that is, without rapid-quenching, compacting, and plastically deforming the compacted body, cannot obtain a sufficiently high IHc and cannot be utilized as material for practical use. The results obtained from example 1 are shown in Table 2 together with the results from the two samples made as comparative references.

Example 2

It is shown in the next example how the deformation ratio used in the upsetting process affects the anisotropic bond magnet which can be obtained. The conditions of the composition, rapidly-quenching, hot press, lateral magnetic field molding, heat treatment, thermosetting etc. are same as those in example 1. The results are shown in Table 3. The magnetic properties shown in Table 3 are the values obtained using a magnetizing strength of 25 KOe. As shown in Table 3, by increasing the deformation ratio, the magnetic properties of the anisotropic bond magnet are improved. When the deformation ratio was ho/h≧5.6, cracks were generated in the periphery of the sample after the upsetting process, but these did not appear to affect the anisotropic bond magnet of the compression-molded type which was the ultimate product.

TABLE 2

| | | Results of example 1 | | | | |
|---|---|---|---|---|---|---|
| Sample | Average Crystal Grain Size | Br (KG) | BHc (KOe) | IHc (KOe) | (BH)max (MHOe) | Remarks |
| The invention | 0.09 | 6.8 | 6.3 | 12.3 | 10.6 | Anisotropic bond magnet |
| Reference 1 | 0.06 | 5.9 | 4.9 | 12.8 | 6.6 | Isotropic bond magnet |
| Reference 2 | 200 | 5.0 | 0.8 | 1.2 | 1.2 | Anisotropic bond magnet |

*Ingot was used as the starting raw material.

TABLE 3

| | Results of example 2 | | | | |
|---|---|---|---|---|---|
| Deformation Ratio (ho:h) | Average Crystal Grain Size (μm) | Br (KG) | BHc (KOe) | IHc (KOe) | (BH)max (MGOe) |
| 2.4 | 0.07 | 6.0 | 5.3 | 13.5 | 7.1 |
| 3.0 | 0.09 | 6.8 | 6.3 | 12.3 | 10.6 |
| 4.1 | 0.10 | 7.0 | 6.5 | 12.0 | 11.2 |
| 5.6 | 0.11 | 7.2 | 6.6 | 12.0 | 11.8 |
| 6.3 | 0.11 | 7.3 | 6.7 | 11.9 | 12.1 |
| 7.2 | 0.11 | 7.3 | 6.8 | 11.9 | 12.3 |

Example 3

An $Nd_{14}Fe_{80}B_6$ alloy was converted into magnetic powder using the same method as for example 1. The magnetic powder was kneaded with 33 vol % of EVA and pellets were made. Using the pellets, injection molding was done at 150° C. The form of the test piece obtained from injection molding was 20 mm dia.×10 mm t, and the magnetic field applied at the time of injection molding was 8 KOe. The magnetic properties obtained were Br=5.6 KG, BHc=4.0 KOe, IHc=13.0 KOe, (BH)max=6.4 MGOe. The magnetic properties were the values obtained with a magnetizing field strength of 25 KOe.

Example 4

Anisotropic bond magnets having the compositions shown in Table 4 were prepared using the same method as for example 1. The bond magnets were formed by compression molding. The resulting magnetic properties are shown in Table 5.

TABLE 4

| Compositions of bond magnet of Example 4 | |
|---|---|
| Sample No. | Compositions |
| 1 | $Nd_{14}Fe_{80}B_6$ |
| 2 | $Nd_{12}Dy_2Fe_{80}B_6$ |
| 3 | $Nd_6Pr_6Dy_2Fe_{80}B_6$ |
| 4 | $Nd_{12}Dy_2Fe_{80}B_5A_1$ |
| 5 | $Nd_{14}Fe_{79}B_6Si$ |
| 6 | $Nd_{14}Fe_{79}B_6NB$ |
| 7 | $Nd_{14}Fe_{79}B_6Zr$ |
| 8 | $Nd_{14}Fe_{79}B_6P$ |
| 9 | $Nd_{14}Fe_{79}B_6C$ |

TABLE 5

| | Magnetic properties of samples from example 4 | | | |
|---|---|---|---|---|
| Sample No. | Br (KG) | BHc (KOe) | IHc (KOe) | (BH)max (MGOe) |
| 1 | 6.8 | 6.3 | 12.3 | 10.6 |
| 2 | 6.6 | 6.3 | 18.0 | 10.0 |

TABLE 5-continued

| Sample No. | Magnetic properties of samples from example 4 Br (KG) | BHc (KOe) | IHc (KOe) | (BH)max (MGOe) |
|---|---|---|---|---|
| 3 | 6.7 | 6.4 | 19.0 | 10.3 |
| 4 | 6.7 | 6.3 | 19.7 | 10.4 |
| 5 | 6.6 | 6.2 | 11.0 | 10.1 |
| 6 | 6.5 | 6.0 | 12.0 | 10.2 |
| 7 | 6.4 | 5.9 | 10.0 | 9.8 |
| 8 | 6.5 | 6.0 | 12.8 | 10.1 |
| 9 | 6.4 | 6.0 | 10.0 | 8.9 |

Example 5

Magnetic powder was made from an $Nd_{16}Fe_{75}B_7AlSi$ alloy by the same method as for example 1. Using the magnetic powder, pellets were made by kneading the magnetic powder with binder EVA and a ring-shaped magnet having an inner diameter 12 mm, outer diameter 16 mm and height 25 mm was obtained by injection molding. The anisotropy of the said magnet was in the radial direction and, in order to evaluate the magnetic properties, a sample of 1.5 mm×1.5 mm×1.5 mm was cut and magnetic measurements were conducted with the cut sample. The magnetic properties measured were Br=5.5 KG, BHc=4.7 KOe, IHc-15.0 KOe, (BH)max=6.3 MGOe.

Example 6

An anisotropic bond magnet of the compression-molded type composed of an $Nd_{13}DyFe_{79}B_6Al$ alloy was prepared using the same method as in example 1. The magnetic properties were Br=6.6 KG, BHc=6.2 KOe, IHc=21.0 KOe, (BH) max=10.2 MGOe. The crystal grain size of the magnet was 0.11 μm. The magnet was machined to 10 mm dia.×7 mm t, and the thermal stability was tested. The results are shown in FIG. 1. For comparison with the sample, an anisotropic sintered magnet with same composition as that of the sample was used.

It can be seen that the anisotropic bond magnet made by the invention has a thermal stability superior when compared to the anisotropic sintered magnet of the same material but inferior to the $Sm_2Co_{17}$ anisotropic sintered magnet.

Example 7

$Nd_{14}Fe_{80}B_6$ anisotropic bond magnets were made using the same method as in the example 1 except for the crushed grain size of the magnetic powder. By using an $Nd_{13}Dy_2Fe_{78}B_7$ anisotropic sintered magnet for reference, the change in the coersive force depending on the change in the crushed grain size was investigated. The results are shown in Table 6. Although, when the sintered body is crushed, the coersive force is lowered and becomes unusable as a raw material for making bond magnets, it is seen that the material made by the invention shows almost no lowering of the coersive force.

TABLE 6

| Crushed grain size | Results of investigation concerning change in coersive force due to change in crushed grain size — Coersive force: Material made by the invention | Material made by crushing the sintered body |
|---|---|---|
| Before crushing | 12.3 | 18.8 |

TABLE 6-continued

| Crushed grain size | Results of investigation concerning change in coersive force due to change in crushed grain size — Coersive force: Material made by the invention | Material made by crushing the sintered body |
|---|---|---|
| 250–500 μm | 12.2 | 5.7 |
| 177–250 μm | 12.1 | 4.2 |
| 105–177 μm | 12.2 | 3.6 |
| 49–105 μm | 12.1 | 2.8 |
| 0–49 μm | 12.0 | 2.1 |

Example 8

Anisotropic bond magnets were made using the same method as for example 1 except that the crystal grain size was changed by changing the temperature for upsetting. The results are shown in Table 7.

TABLE 7

| Average crystal grain size (μm) | Magnetic properties of example 8 Br (KG) | 6Hc (KOe) | iHc (KOe) | (BH)max (MGOe) |
|---|---|---|---|---|
| 0.01 | 5.7 | 4.6 | 8.9 | 6.9 |
| 0.09 | 6.8 | 6.3 | 12.3 | 10.6 |
| 0.17 | 6.9 | 6.1 | 11.5 | 10.7 |
| 0.38 | 6.5 | 6.1 | 10.4 | 10.1 |
| 0.50 | 6.0 | 5.8 | 8.7 | 8.4 |
| 0.80 | 4.3 | 3.6 | 5.2 | 3.8 |

It can be seen that, when the average crystal size is from 0.001 μm to 0.5 μm, the magnet has superior magnetic properties.

Example 9

R-Fe-B system permanent magnets were made using the same method as in example 1 except for the retention time in heat treatment. The results are shown in Table 8. It can be seen that there is no change in the magnetic properties, provided that the retention time at 750° C. is within 240 minutes.

TABLE 8

| Retention time (minutes) | Results of example 9 IHc (KOe) Before heat treatment | After heat treatment |
|---|---|---|
| 0 | 4.8 | 9.0 |
| 10 | 4.8 | 9.3 |
| 30 | 4.8 | 9.3 |
| 60 | 4.8 | 9.3 |
| 120 | 4.8 | 9.2 |
| 240 | 4.8 | 9.1 |

Example 10

R-Fe-B system permanent magnets were made using the same method as in example 1 except that the heat treatment temperatures were varied and the retention time was set to 10 minutes. The results are shown in Table 9. It can be seen that superior magnetic properties are shown when the heat treatment temperature is 600°–900° C.

TABLE 9

| Heat treatment temperature (°C.) | Results of example 10 IHc after heat treatment (KOe) |
|---|---|
| Not heat treated magnet | 4.8 |

TABLE 9-continued

| Results of example 10 | |
|---|---|
| Heat treatment temperature (°C.) | IHc after heat treatment (KOe) |
| 500 | 4.8 |
| 550 | 4.8 |
| 600 | 5 4 |
| 650 | 6.0 |
| 700 | 7.8 |
| 750 | 9.3 |
| 800 | 9.0 |
| 850 | 8.0 |
| 900 | 5.2 |
| 950 | 4.3 |

Example 11

R-Fe-B permanent magnets were made using the same method as in example 1 except that the retention time was set to 10 minutes and the cooling method was varied. The results are shown in Table 10 and suggest that superior results can be obtained when the cooling speed is 1° C./sec or greater.

TABLE 10

| Results of example 11 | | |
|---|---|---|
| Cooling method | Cooling speed (°C./sec) | Coersive force (KOe) |
| Water cooling | 370 | 12.8 |
| Oil cooling | 180 | 11.6 |
| Ar quenching | 61 | 10.7 |
| Ar gradual cooling | 18 | 8.2 |
| Vacuum cooling leaving as it is | 4 | 7.9 |
| Furnace cooling | 0.3 | 7.1 |
| Before heat treatment | — | 7.4 |

As described above, the magnetic powder for anisotropic bond magnets made in accordance with the invention is excellent in terms of the magnetizing properties, its irreversible demagnetizing factor is small even in the environment of relatively high temperatures and, therefore, it is useful for anisotropic bond magnets which can be magnetized after the magnet has been assembled.

What is claimed is:

1. Magnetically anisotropic bond magnet consisting essentially of 15–40 vol % of resin binder and the balance alloy powder of the R-TM-B-M system, wherein R is at least one of the rare earth elements including Y, TM is Fe or Fe a part of which has been substituted with Co., B is boron, and M is at least one additive selected from the group consisting of Si, Al, Nb, Zr, P and C; wherein the R-TM-B-M system alloy powder has an average crystal size of 0.01–0.5 μm, an average grain size of 1–1,000 μm, a flattened grain structure with (c) greater than (a) in which (c) is the average size of the grain in the direction perpendicular to the C-axis and (a) is the average size of the grain in the C-axis direction, and is magnetically anisotropic; and wherein the R-TM-B-M system alloy powder's easy magnetizing axes have been directed to a given direction.

2. The magnetically anisotropic bond magnet as set forth in claim 1, wherein the R-TM-B-M system alloy powder consists essentially of 11–18 at % of rare earth elements, 4–11 at % of boron, 3 at % or less of additives, and the balance iron and unavoidable impurities.

3. The magnetically anisotropic bond magnet as set forth in claim 1, wherein the R-TM-B-M system anisotropic alloy powder is produced by the process comprising the steps of rapidly-quenching the molten metal of the R-TM-B-M alloy to make flakes of the alloy compacting the flakes to form a high density body, plastically deforming the body to cause magnetic anisotropy in the body, and crushing the plastically deformed body.

4. The magnetically anisotropic bond magnet as set forth in claim 3, wherein the anisotropy is caused by a hot upsetting process.

5. The magnetically anisotropic bond magnet as in claim 1 wherein the average ratio of (c) to (a) is 2 or more.

6. The bond magnet as in claim 3, wherein the deformation ratio of the body is at least about 2.4.

7. The bond magnet as in claim 3, wherein the deformation ratio of the body is at least about 3.0.

8. The bond magnet as in claim 3, wherein the deformation ratio of the body is at least about 4.1.

9. The bond magnet as in claim 3, wherein the deformation ratio of the body is at least about 5.6.

10. The bond magnet as in claim 3, wherein the deformation ratio of the body is at least about 6.3.

11. The bond magnet as in claim 3, wherein the deformation ratio of the body is at least about 7.2.

12. The magnetically anisotropic bond magnet as set forth in claim 1, wherein the R-TM-B-M system alloy powder consist essentially of 11–18 at % of rare earth elements, 4–11 at % of boron, 30 at % or less of Co, 3 at % or less of additives, and the balance part of iron and unavoidable impurities.

13. Magnetically anisotropic bond magnet consisting essentially of 15–40 vol % of resin binder and the balance alloy powder of the R-TM-B-M system, wherein R is at least one of the rare earth elements including Y, TM is Fe or Fe a part of which has been substituted with Co, B is boron, and M is at least one additive selected from the group consisting of Si, Al, Nb, Zr, P and C; wherein the R-TM-B-M system alloy powder has an average crystal size of 0.01–0.5 μm, is magnetically anisotropic, has an average grain size of 1–1,000 μm, and the grains of which have been plastically deformed to provide said anisotropy; and the R-TM-B-M system alloy powder's easy magnetizing axes have been directed to a given direction.

14. The magnetically anisotropic bond magnet as set forth in claim 13, wherein the R-TM-B-M system alloy powder consists essentially of 11–18 at % of rare earth elements, 4–11 at % of boron, 3 at % or less of additives, and the balance iron and unavoidable impurities.

15. The magnetically anisotropic bond magnet as set forth in claim 13, wherein the R-TM-B-M system anisotropic alloy powder is produced by the process comprising the steps of rapidly-quenching the molten metal of the R-TM-B-M alloy to make flakes of the alloy compacting the flakes to form a high density body, plastically deforming the body to cause magnetic anisotropy in the body, an crushing the plastically deformed body.

16. The magnetically anisotropic bond magnet as set forth in claim 15, wherein the alloy powder grains have been plastically deformed by a hot upsetting process.

17. The magnetically anisotropic bond magnet as set forth in claim 13, wherein the average ratio (c)/(a) of said plastically deformed alloy powder grains is 2 or more, in which (c) is the average size of the crystal grain in the direction perpendicular to C-axis and (a) is the average size of the crystal grain in C-axis direction.

18. The bond magnet as in claim 15, wherein the deformation ratio of the body is at least about 2.4.

19. The bond magnet as in claim 15, wherein the deformation ratio of the body is at least about 3.0.

20. The bond magnet as in claim 15, wherein the deformation ratio of the body is at least about 4.1.

21. The bond magnet as in claim 15, wherein the deformation ratio of the body is at least about 5.6.

22. The bond magnet as in claim 15, wherein the deformation ratio of the body is at least about 6.3.

23. The bond magnet as in claim 15, wherein the deformation ratio of the body is at least about 7.2.

24. The magnetically anisotropic bond magnet as set forth in claim 13, wherein the R-TM-B-M system alloy powder consist essentially of 11–18 at % of rare earth elements, 4–11 at % of boron, 30 at % or less of Co, 3 at % or less of additives, and the balance iron and unavoidable impurities.

25. A ring-shaped magnetically anisotropic bond magnet consisting essentially of 15–40 vol % of resin binder and the balance alloy powder of the R-TM-B-M system, wherein R is at least one of the rare earth elements including Y, TM is Fe or Fe a part of which has been substituted with Co, B is boron, and M is at least one additive selected from the group consisting of Si, Al, Nb, Zr, P and C; wherein the R-TM-B-M system alloy powder has an average crystal size of 0.01–0.5 μm, an average grain size of 1–1,000 μm, a flattened grain structure with (c) greater than (a) in which (c) is the average size of the grain in the direction perpendicular to the C-axis and (a) is the average size of the grain in the C-axis direction, and is magnetically anisotropic; and wherein the R-TM-B-M system alloy powder's easy magnetizing axes have been directed to a given direction in the ring.

26. The ring-shaped bond magnet as in claim 25, wherein said given direction is the radial direction.

27. Magnetically anisotropic bond magnet consisting essentially of 15–40 vol % of resin binder and the balance alloy powder of the R-TM-B-M system, wherein R is at least one of the rare earth elements including Y, TM is Fe or Fe a part of which has been substituted with Co, B is boron, and M is at least one additive selected from the group consisting of Si, Al, Nb, Zr, P and C; wherein the R-TM-B-M system alloy powder has an average crystal size of 0.01–0.5 μm, an average grain size of 1–1,000 μm, a flattened grain structure with (c) greater than (a) in which (c) is the average size of the grain in the direction perpendicular to the C-axis and (a) is the average size of the grain in the C-axis direction, and is magnetically anisotropic; wherein the R-TM-B-M system alloy powder's easy magnetizing axes have been directed to a given direction; and wherein the coercivity of the bond magnet is independent of the grain size.

28. Magnetically anisotropic bond magnet consisting essentially of 15–40 vol % of resin binder and the balance alloy powder of the R-TM-B-M system, wherein R is at least one of the rare earth elements including Y, TM is Fe or Fe a part of which has been substituted with Co, B is boron, and M is at least one additive selected from the group consisting of Si, Al, Nb, Zr, P and C; wherein the R-TM-B-M system alloy powder has an average crystal size of 0.01–0.5 μm, an average grain size of 1–1,000 μm, a flattened grain structure with (c) greater than (a) in which (c) is the average size of the grain in the direction perpendicular to the C-axis and (a) is the average size of the grain in the C-axis direction, and is magnetically anisotropic; wherein the R-TM-B-M system alloy powder's easy magnetizing axes have been directed to a given direction; and wherein the irreversible demagnetization coefficient is equal to or less than 10% at 130° C.

29. Anisotropic magnetic powder for a magnetically anisotropic bond magnet comprising an alloy powder of the R-TM-B-M system, wherein R is at least one of rare earth elements including Y, TM is Fe or Fe a part of which has been substituted with Co, B is boron, and M is at least one additive selected from the group consisting of Si, Al, Nb, Zr, P, and C., said powder having an average crystal size of 0.01–0.5 μm, an average grain size of 1–1,000 μm, a flattened grain structure with (c) greater than (a) in which (c) is the average size of the grain in the direction perpendicular to the C-axis and (a) is the average size of the grain in the C-axis direction, and having magnetic anisotropy, wherein the average ratio of c to a is 2 or more.

30. Magnetic powder for magnetically anisotropic bond magnet comprising an alloy powder of the R-TM-B-M system, wherein R is at least one of rare earth elements including Y, TM is Fe or Fe a part of which has been substituted with Co, B is boron, and M is at least one additive selected from the group consisting of Si, Al, Nb, Zr, P and C, said powder having an average crystal grain size of 0.01–0.5 μm, having magnetic anisotropy, having an average grain size of 1–1,000 μm, and the grains of which have been plastically deformed to provide said anisotropy, wherein the average ratio of (c) to (a) is 2 or more, in which (c) is the average size of the crystal grain in the direction perpendicular to C-axis and (a) is the average size of the crystal grain in C-axis direction.

* * * * *

UNITED STATES PATENT AND TRADEMARK OFFICE

CERTIFICATE OF CORRECTION

PATENT NO. : 4,921,553

DATED : May 1, 1990

INVENTOR(S) : Masatoki Tokunaga

It is certified that error appears in the above-identified patent and that said Letters Patent is hereby corrected as shown below:

On the title page item [19] "Tokunga et al." should read --Tokunaga et al.--; and item [75] Inventors: "Masatoki Tokunga" should read --Masatoki Tokunaga--.

Claim 12, column 12, line 30, delete "part of".
Claim 15, column 12, line 58, change "an" to --and--.
Claim 24, column 13, line 15, change "consist" to --consists--.
Abstract, line 9, change "allow" to --alloy--.

Signed and Sealed this

Seventh Day of April, 1992

*Attest:*

HARRY F. MANBECK, JR.

*Attesting Officer*

*Commissioner of Patents and Trademarks*